US006974273B2

(12) United States Patent
Cheng

(10) Patent No.: US 6,974,273 B2
(45) Date of Patent: Dec. 13, 2005

(54) RING BINDER

(75) Inventor: Hung Yu Cheng, Hong Kong (CN)

(73) Assignee: World Wide Stationery Manufacturing Company Limited, Kwai Chung (HK)

( * ) Notice: Subject to any disclaimer, the term of this patent is extended or adjusted under 35 U.S.C. 154(b) by 276 days.

(21) Appl. No.: 10/196,012

(22) Filed: Jul. 16, 2002

(65) Prior Publication Data

US 2004/0013464 A1 Jan. 22, 2004

(51) Int. Cl.[7] ..... B42F 3/04

(52) U.S. Cl. ..... 402/31; 402/19; 402/70; 402/500

(58) Field of Search ..... 402/5, 19, 20, 402/26, 31, 35–42, 70, 73, 500, 502

(56) References Cited

U.S. PATENT DOCUMENTS

| | | | |
|---|---|---|---|
| 819,368 | A | 5/1906 | Nelson |
| 1,278,267 | A | 9/1918 | Whitlock |
| 1,299,276 | A | 4/1919 | Whitlock |
| 1,456,036 | A | 5/1923 | Nissen |
| 1,709,955 | A | 4/1929 | Schade |
| 1,905,418 | A | 4/1933 | Meves |
| 1,929,614 | A | 10/1933 | Tannehill et al. |
| 2,081,372 | A | 5/1937 | Thomas |
| 2,158,056 | A | 5/1939 | Cruzan |
| 2,265,822 | A | 12/1941 | Spalding |
| 2,871,711 | A | 2/1959 | Stark |
| 2,888,934 | A | 6/1959 | Segal |
| 3,159,411 | A | 12/1964 | McKowen |
| 3,175,847 | A | 3/1965 | McKowen |
| 3,255,759 | A | 6/1966 | Dennis |
| 3,333,592 | A | 8/1967 | Huffaker |
| 3,809,485 | A | 5/1974 | Beyer |
| 3,950,107 | A | 4/1976 | Seaborn |

(Continued)

FOREIGN PATENT DOCUMENTS

| | | | |
|---|---|---|---|
| DE | 196 02 813 A1 | | 8/1996 |
| EP | 1382464 | * | 1/2004 |
| GB | 954 417 | | 4/1964 |
| GB | 1 111 435 | | 4/1968 |
| GB | 1 484 908 | | 9/1977 |
| JP | 2004-50833 | * | 2/2004 |

OTHER PUBLICATIONS

United Kingdom Patent Office, Search Report, dated Oct. 29, 2003, 1 page.
European Patent Office, European Search Report, dated Oct. 31, 2003, 2 pages.
Australian Patent Office Written Opinion, Jan. 7, 2004, 4 pages.
Australian Patent Office Search Report, Jan. 7, 2005, 4 pages.

*Primary Examiner*—Monica S. Carter
(74) *Attorney, Agent, or Firm*—Senniger Powers

(57) ABSTRACT

A ring binder including an elongate base plate having ring segments fixed thereto, a flap hinged to the base plate having mating ring segments thereon swingable to open and close the rings, and a crankshaft journalled on the base plate for swinging the flap.

27 Claims, 20 Drawing Sheets

U.S. PATENT DOCUMENTS 4,295,747 A 10/1981 Errichiello
4,522,526 A 6/1985 Lozfau et al.
4,697,945 A 10/1987 Geiger
4,722,628 A 2/1988 Rager
4,815,882 A 3/1989 Ohminato
4,830,528 A 5/1989 Handler
4,935,998 A 6/1990 Frazier et al.
5,035,526 A 7/1991 Cooper et al.
5,100,253 A 3/1992 Cooper
5,106,223 A 4/1992 Kraus
5,160,209 A 11/1992 Schuessler
5,180,247 A 1/1993 Yu
5,265,967 A 11/1993 Han
5,269,616 A 12/1993 O'Neill
5,286,128 A 2/1994 Gillum
5,354,142 A 10/1994 Yu
5,368,407 A 11/1994 Law
5,378,073 A 1/1995 Law
5,393,155 A 2/1995 Ng
5,476,335 A 12/1995 Whaley
5,577,852 A 11/1996 To
5,755,513 A 5/1998 To
5,842,807 A 12/1998 To
5,879,097 A 3/1999 Cheng
5,975,784 A 11/1999 Whaley
6,019,538 A 2/2000 Whaley
6,033,144 A 3/2000 Ng et al.
6,168,339 B1 1/2001 To
2004/0013464 A1 * 1/2004 Cheng ..... 402/31

* cited by examiner

RING BINDER

BACKGROUND OF THE INVENTION

This invention relates to binders for holding loose leaf pages, and in particular to an improved mechanism for opening and closing binders.

A ring binder retains loose leaf pages, such as hole-punched papers, in a file or notebook. It features ring members for retaining the papers which may be selectively opened to add or remove papers, or closed to retain papers while allowing them to be moved along the ring members. Levers are typically provided on both ends of the binder for moving the ring members between the open and closed positions.

One drawback to ring binders of the prior art is that when ring members are being closed, they snap shut with a strong magnitude of force which can cause injury. Further, many ring binders of the prior art have ring members which are not lockable in the closed position, thereby being vulnerable to inadvertently opening when heavily loaded with loose leaf papers. Also, the clamping force within each ring is not uniform with the clamping force in other rings, causing uneven movement and potentially resulting in gaps on closed rings.

Reference is made to the following co-assigned U.S. Patents for background regarding ring binder mechanisms:

| Patent No. | Date | Title |
|---|---|---|
| 5,354,142 | Oct. 11, 1994 | Ring Binder |
| 5,577,852 | Nov. 26, 1996 | Ring Binder Mechanism |
| 5,755,513 | May 26, 1998 | Ring Binder |
| 5,842,807 | Dec. 1, 1998 | Ring Binder |
| 5,879,097 | Mar. 9, 1999 | Ring Binder |
| 6,033,144 | Mar. 7, 2000 | Ring Binder Mechanism |
| 6,168,339 | Jan. 2, 2001 | Ring Binder |

SUMMARY OF THE INVENTION

Among the several objects and features of the present invention may be noted the provision of a ring binder particularly for use in a loose-leaf binder having improved mechanism for the opening and closing of the ring binder rings; the provision of such a ring binder wherein the mechanism acts to securely lock the rings in closed position and is readily manipulable to open the rings; the provision of such a ring binder which inhibits injury to operators; the provision of such a ring binder which provides uniform clamping force in each ring; and the provision of such a ring binder which is serviceable and reliable in operation and of reasonably economical construction.

In general, the ring binder of this invention comprises an elongate base having opposite sides and ends and rings spaced longitudinally of the base. Each ring comprises a pair of ring segments, one segment of each pair being mounted on the base for swinging movement about an axis extending lengthwise of the base between a ring-closing position and a ring-opening position. A shaft is mounted on the base for rotation on an axis extending lengthwise of the base, said shaft having at least one offset. Further, the ring binder has at least one link extending from the offset to the swinging ring segments, whereby on rotation of the shaft and offset in one direction the swinging ring segments swing from their ring-closing position to their ring-opening position and on rotation of the shaft and offset in the opposite direction the swinging ring segments swing from their ring-opening position to their ring-closing position.

In another aspect, a ring binder of the present invention is particularly for use in a loose-leaf binder. The ring binder comprises an elongate base having opposite sides and ends, and a flap extending along one side of the base hinged to the base for swinging movement about an axis extending along said one side between a raised and a lowered position. Rings each comprise a ring segment fixed to the base and a mating ring segment secured to the flap. The mating ring segments are swung away from the fixed ring segments when the flap is down in lowered position so that the rings are then open. The mating ring segments are closed on the fixed ring segments when the flap is up in raised position so that the rings are then closed. A shaft is mounted on the base for rotation on an axis extending longitudinally of the base, the shaft having at least one offset. A link extends from the offset to the flap for swinging the flap.

In yet another aspect, a ring binder of the present invention is particularly for use in a loose-leaf binder. The ring binder comprises an elongate sheet metal plate constituting the base of the ring binder having opposite sides and ends. An elongate sheet metal flap extends along one side of the plate hinged thereto for swinging movement about an axis extending along said one side for swinging movement between a raised position relative to the plate and a lowered position generally coplanar with the plate. Rings each comprise a ring segment fixed to the plate and a mating ring segment secured to the flap. The mating ring segments are swung away from the fixed ring segments when the flap is at the lowered position so that the rings are open. The mating ring segments are closed on the fixed ring segments when the flap is at the raised position so that the rings are then closed. The flap is hinged to the plate by at least one spring wire hinge on the bottom of the plate and flap. The spring wire hinge tends to bias the flap down to its lowered position. A crankshaft is journalled on the base by clips struck up from the base and has at least one crank and a crank arm at an end thereof for turning the crankshaft. At least one link extends from said at least one crank to the flap. The link is pivotally connected to the flap and has a hook formation for hooking around said at least one crank.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 25:
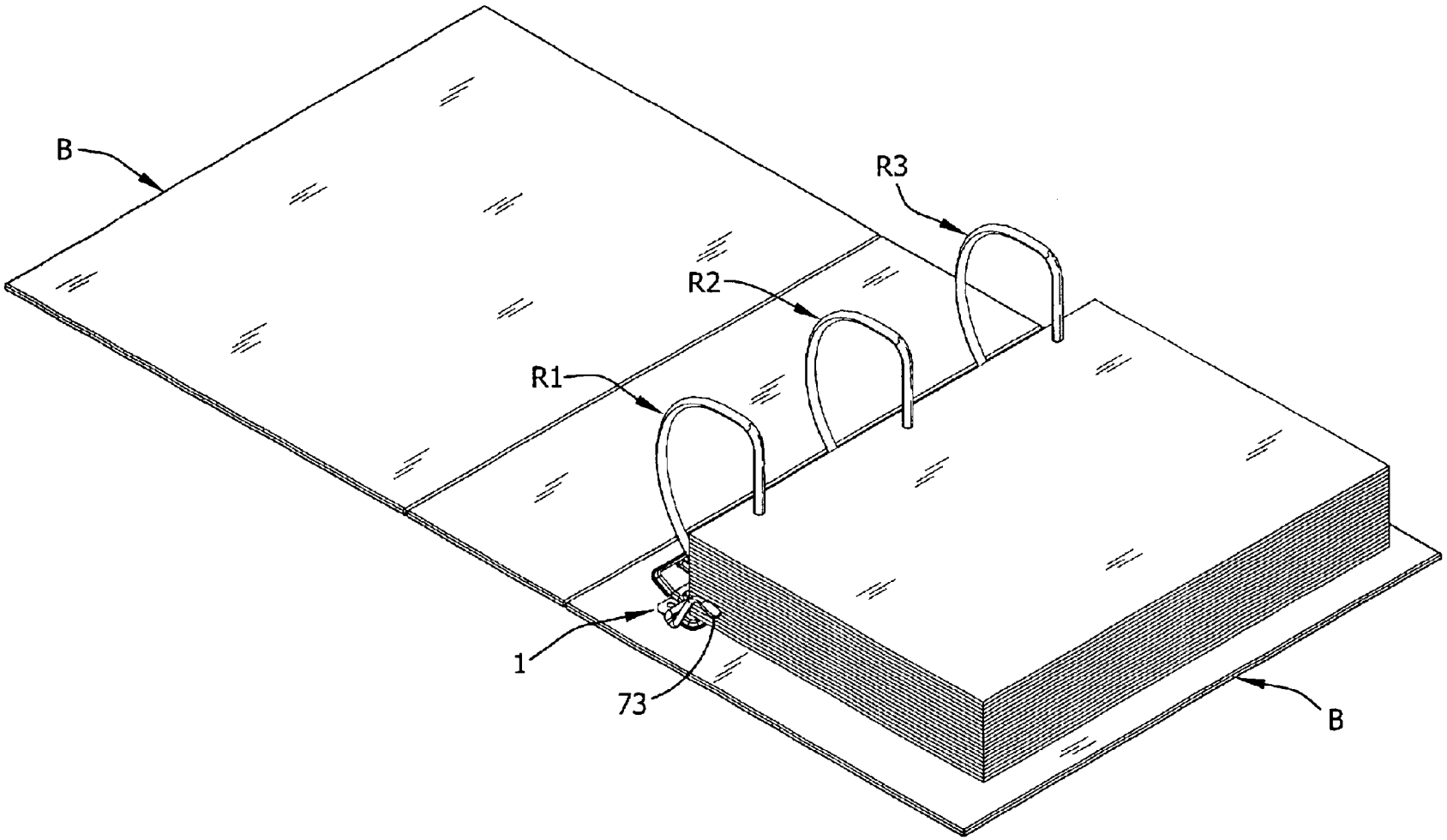
FIG. 25 shows the ring binder shown in of FIGS. 1–8 as used in a loose-leaf folder.

Referring to the drawings and especially to FIGS. 1–17, a ring binder of this invention, designated 1 in its entirety, is particularly for use in a loose-leaf folder B as illustrated in FIG. 25. The ring binder 1 is shown to comprise an elongate base, designated 3 in its entirety, having opposite sides 5 and 7 and ends 9 and 11, and rings each basically designated R spaced longitudinally of the base.

The base 3 is generally rectangular in shape with a low profile, preferably stamped from sheet metal. The base 3 has holes 75 for receiving fasteners (not shown) for fastening the ring binder 1 to the loose-leaf binder B as shown in FIG. 25, for example. The base 3 is flanged along its side 7 as indicated at 7*a* and at its ends 9 and 11 as indicated at 9*a* and 11*a*. The flanges provide a smooth peripheral edge and facilitate firm engagement of the base 3 with the binder B. It is understood that the base can have a variety of other shapes or configurations without departing from the scope of this invention.

Figure 13:
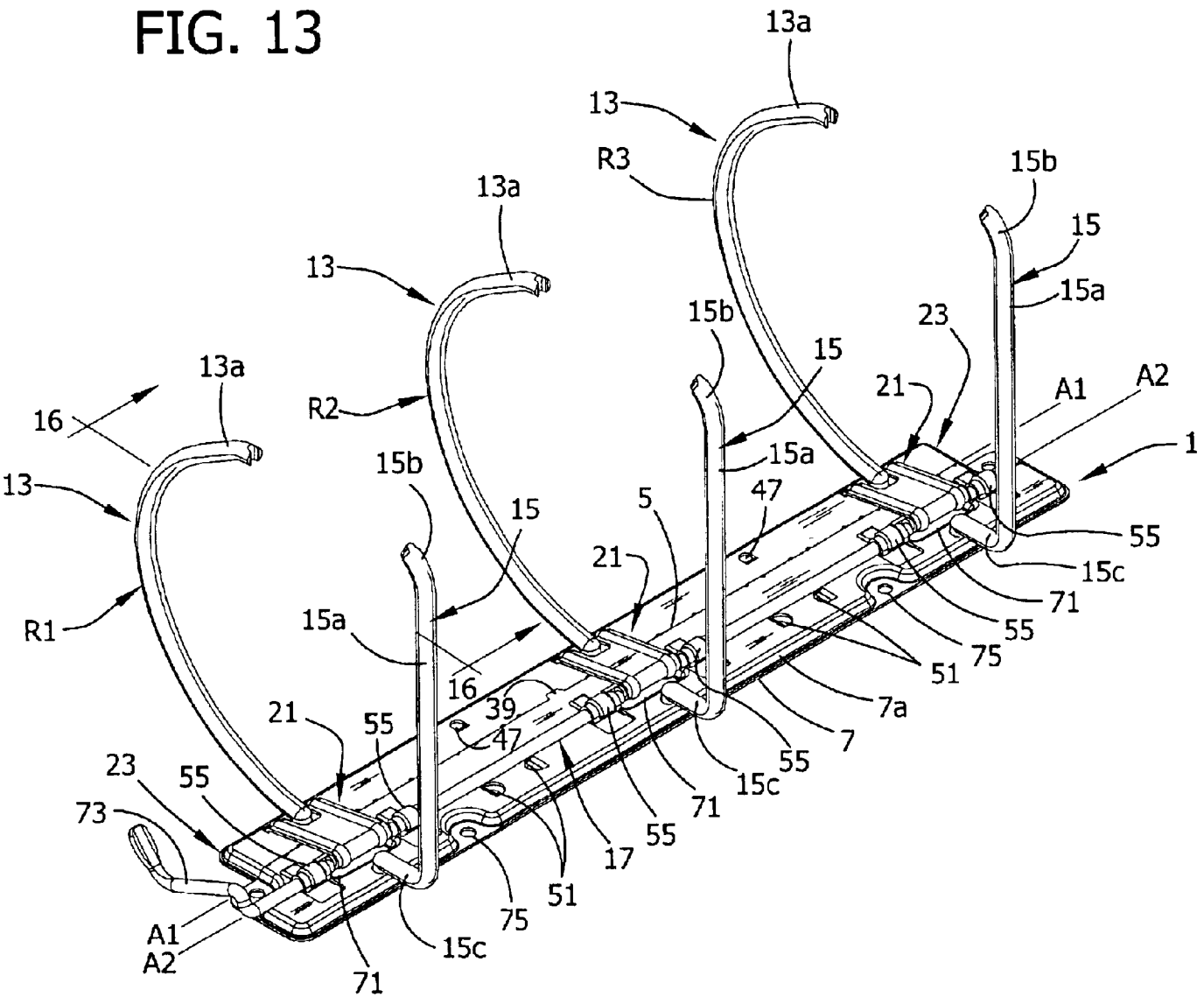
FIG. 13 is a perspective like FIGS. 5 and 9 showing the rings open.
Figure 14:
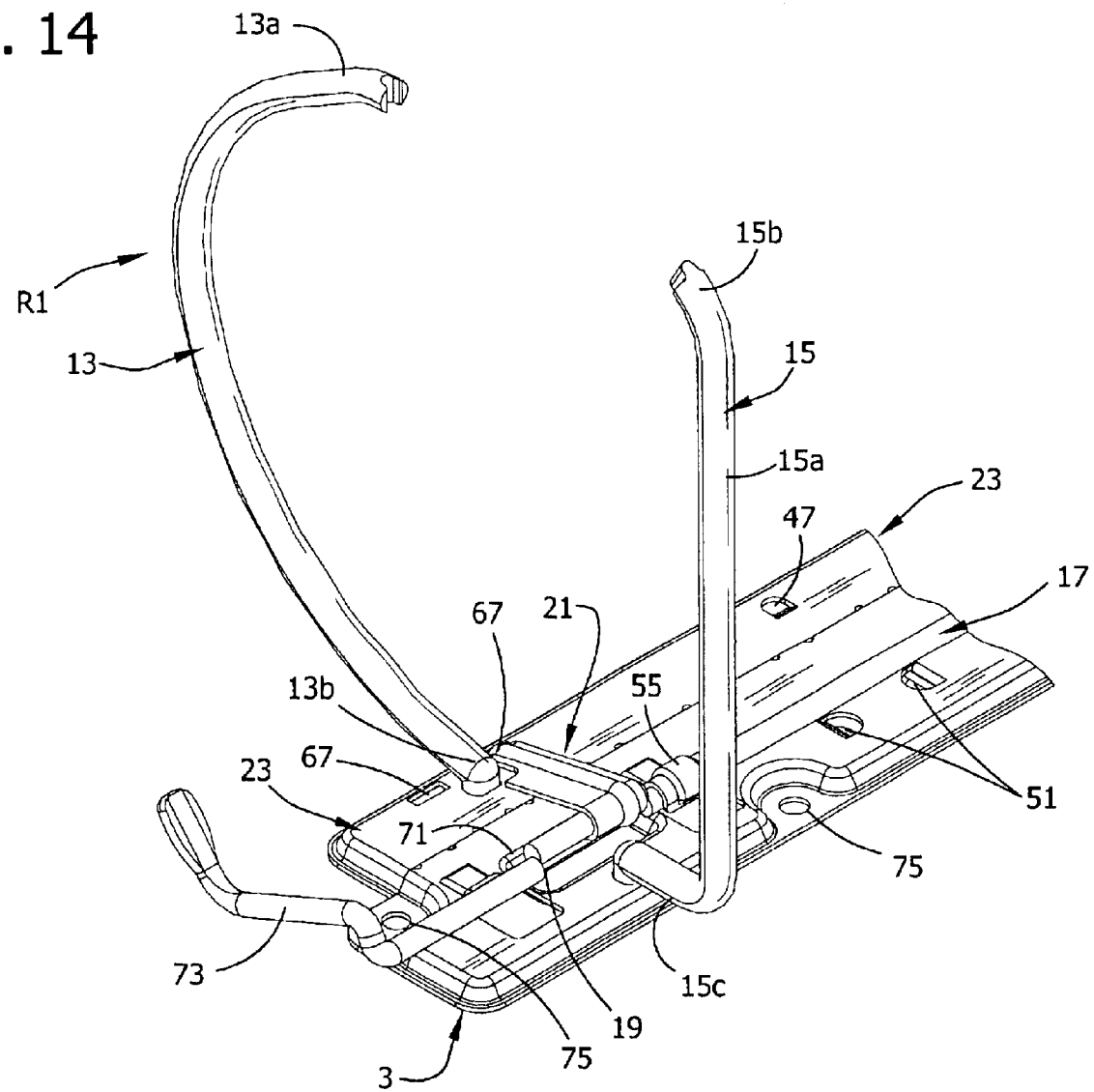
FIG. 14 is an enlarged fragment of FIG. 13, a part being broken away.
Figure 15:
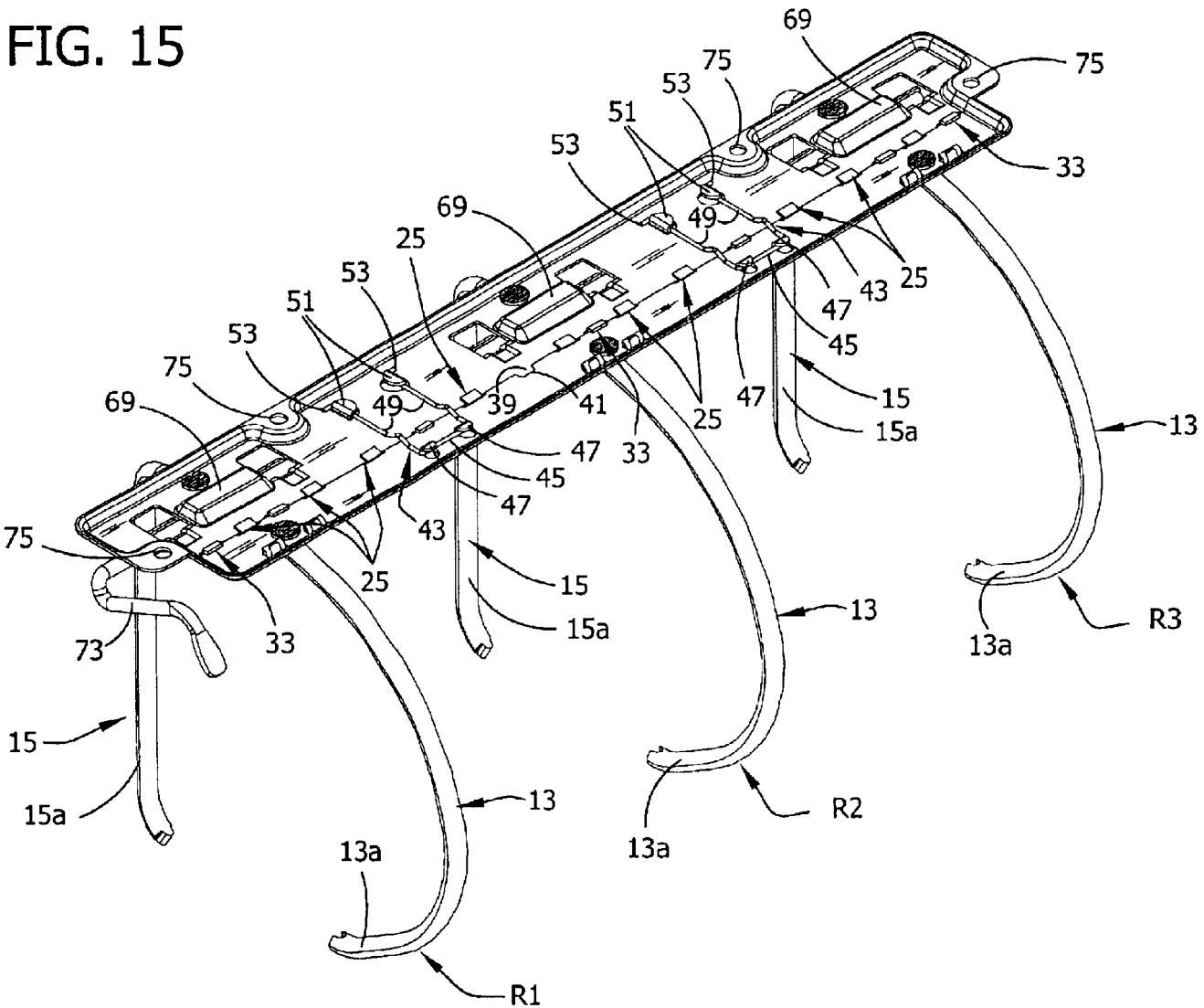
FIG. 15 is a perspective as viewed from the bottom of FIG. 13.
Figure 16:
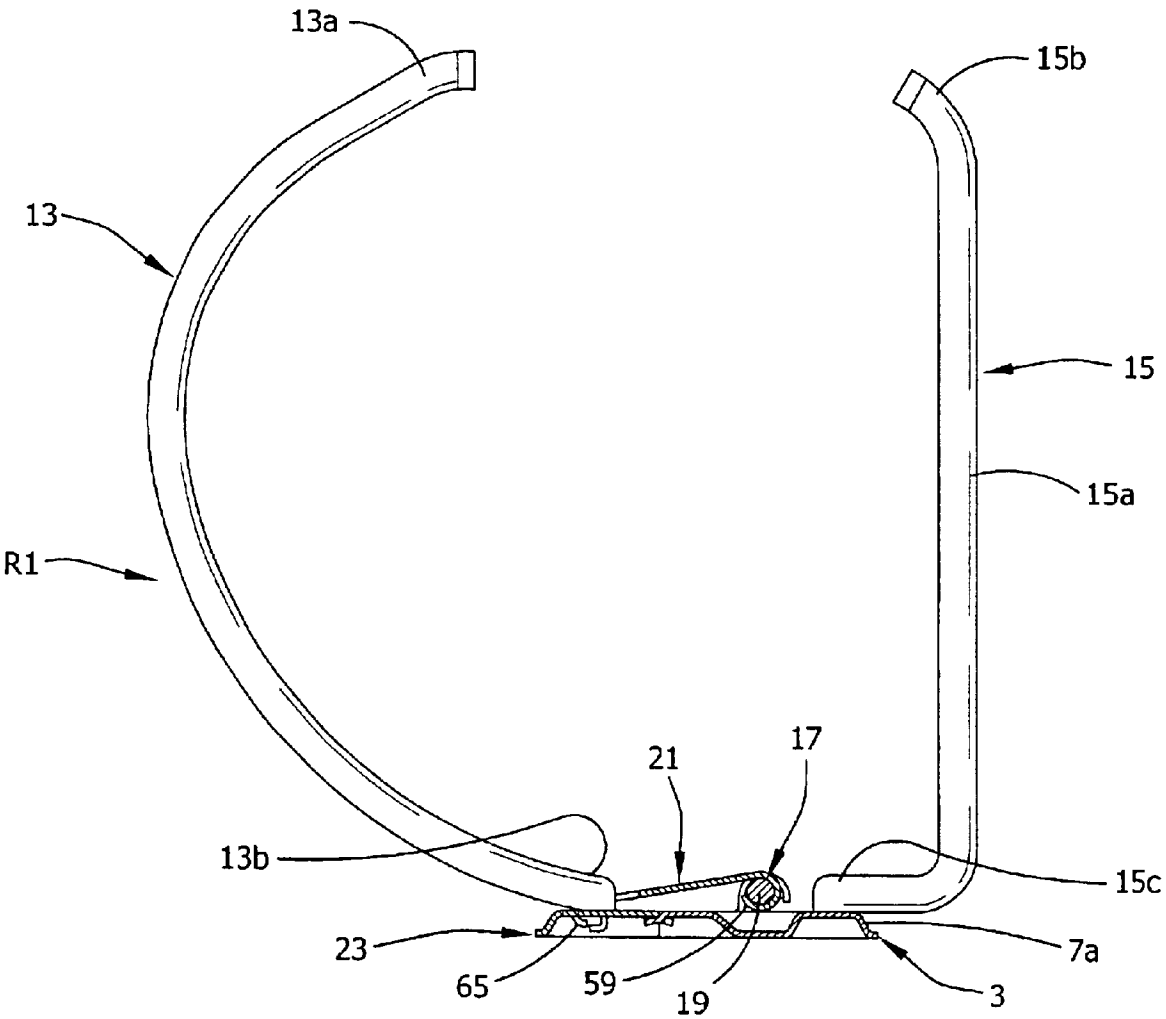
FIG. 16 is a vertical section taken generally on line 16—16 of FIG. 13.

A sheet metal flap 23 extends along side 5 of the base plate 3 hinged to the base as described hereinafter for swinging movement about axis A1 extending along side 5 for swinging movement between a raised position relative to the base (see FIGS. 4–6 and 8 particularly) and a lowered position generally coplanar with the base (see FIGS. 13 and 14). The flap 23 is generally elongate and rectangular, with a first side hinged to the base along axis A1 and a second side positioned away from the base. The flap 23 has a shorter length than the base 3, but it could have any relative length.

Figure 1:
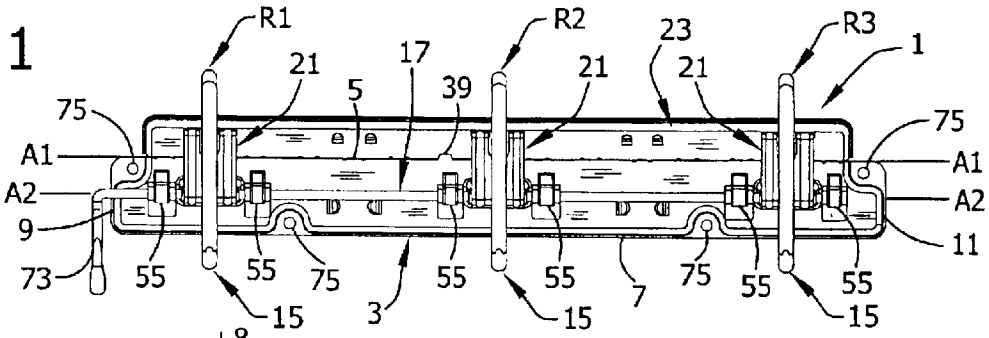
FIG. 1 is a top plan of a first version of the ring binder of this invention, showing the rings thereof closed and locked in the closed position.
Figure 2:
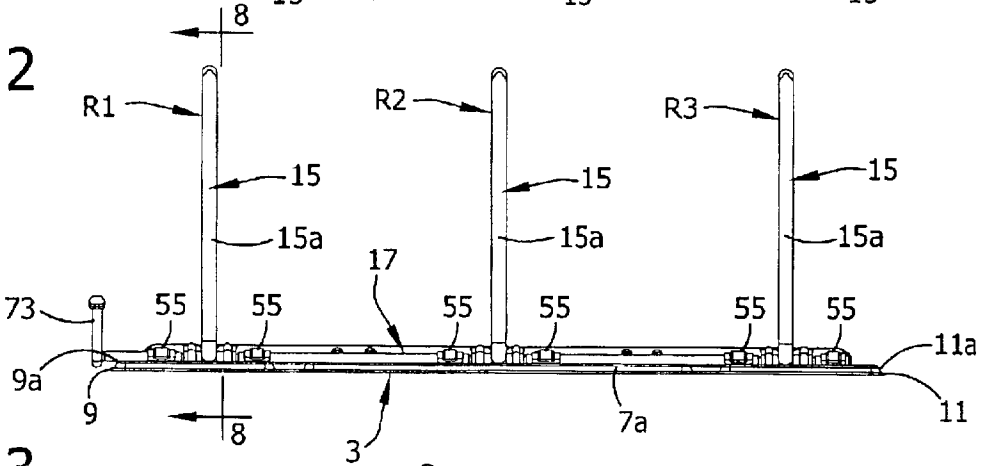
FIG. 2 is a side elevation thereof.
Figure 3:
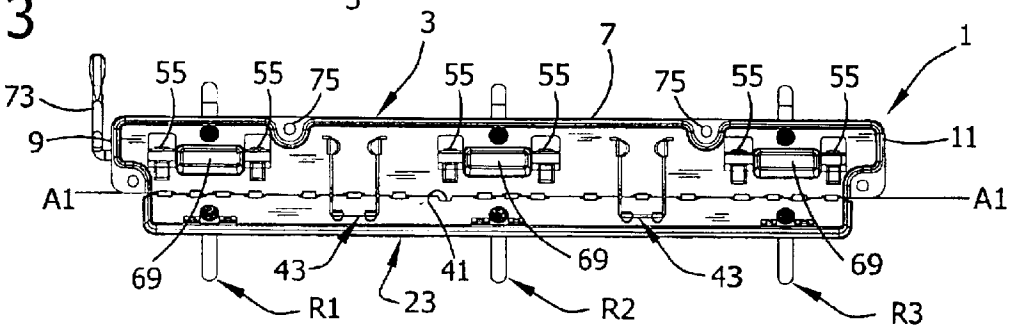
FIG. 3 is a bottom plan thereof.
Figure 4:
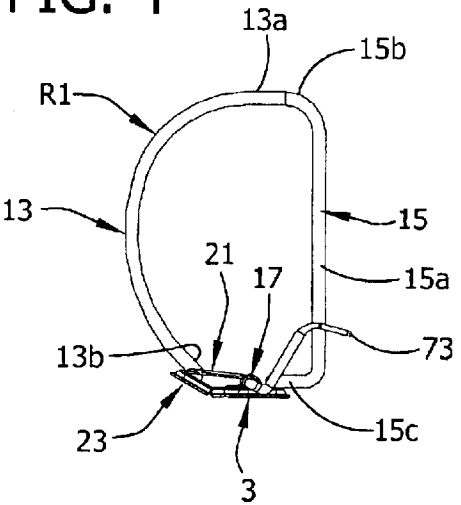
FIG. 4 is an end elevation thereof as viewed from the left of FIG. 2.

The ring binder 1, as illustrated, is a three-ring binder, having a ring R1 adjacent end 9 of the base, a ring R2 generally in the middle of the base, and a ring R3 adjacent end 11. Rings R1 and R3 may be referred to as the end rings; R2 as the central ring. Each ring R1, R2, R3 comprises a pair of ring segments 13 and 15 (the same for all the rings). As shown, each ring segment 13 is a generally concavo-convex segment having an upper end 13*a* and a lower end 13*b* (FIG. 4). Each ring segment 15 has a relatively long linear upright component 15*a* having an upper end 15*b* and a lower end 15*c* extending laterally therefrom. One segment of each pair 13, 15, namely segment 13, is mounted for swinging movement about axis A1 extending lengthwise of the base between a ring-closing position (see FIGS. 4–7) and a ring-opening position (see FIGS. 13–16). It is understood that the ring binder can have any number of rings of substantially any shape, and that the ring segment 15 may also be mounted for movement, without departing from the scope of this invention.

Each ring segment 15 has its lower end 15*c* secured as by welding on the base 3, its linear component 15*a* extending upwardly therefrom. The ring segments 15 are therefore in generally fixed position relative to the base 3. Each ring segment 13 (which mates with a segment 15) has its lower end 13*b* secured as by welding on the flap 23 and extends upwardly therefrom. The ring segments 13 are swung away from the fixed ring segments 15 when the flap 23 is down in the lowered position so that the rings are then open (see FIGS. 13–16). The ring segments 13 are closed on the fixed ring segments 15 when the flap 23 is up in raised position so that the rings R1, R2, R3 are then closed.

Figure 17:
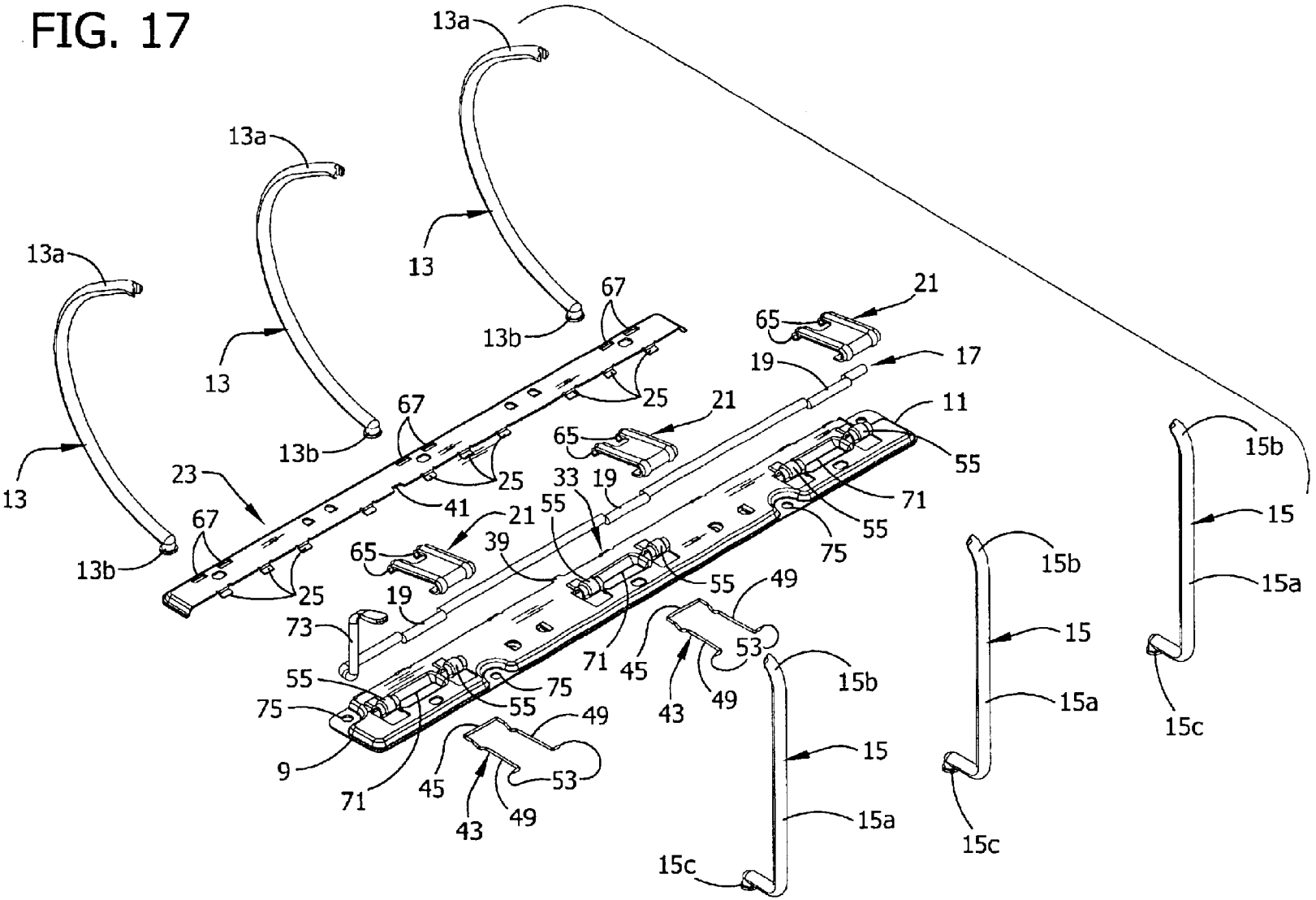
FIG. 17 is an exploded view showing the parts of the ring binder illustrated in FIGS. 1–16 piece-by-piece.
Figure 18:
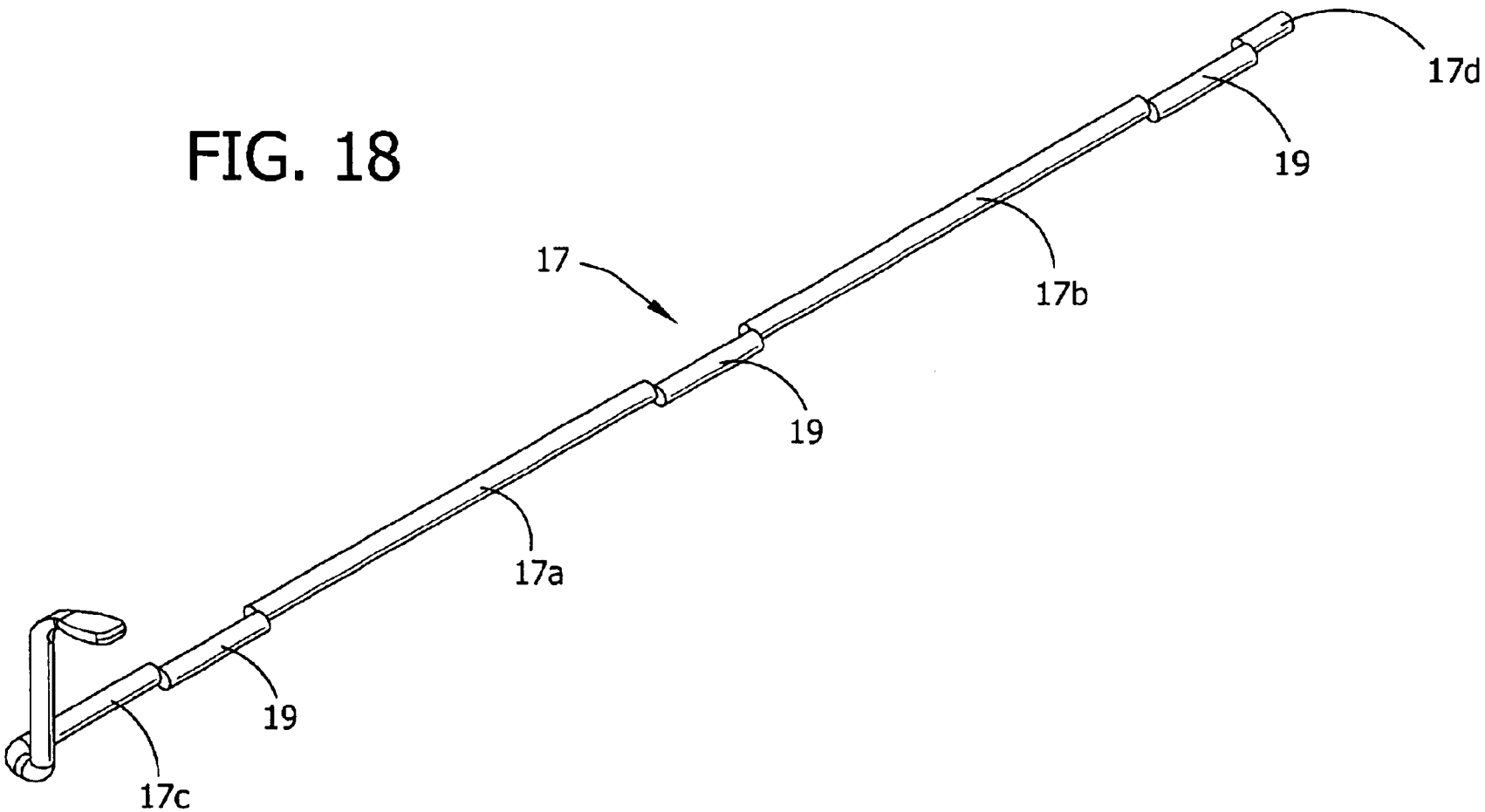
FIG. 18 is a perspective illustrating the crankshaft per se of said ring binder on a larger scale than in FIG. 17.

A shaft designated 17 in its entirety is mounted on the base 3 for rotation on an axis A2 extending lengthwise of the base (parallel to axis A1). This shaft is broadly referred to as having at least one offset 19 (FIG. 18), such that the shaft may be denoted a crankshaft, the offsets 19 constituting cranks. The ring binder 1 has at least one link 21 extending from the offset 19 to the swinging ring segments 13 whereby on rotation of the shaft 17 and offset in one direction (counterclockwise in FIGS. 4 and 5) the swinging ring segments 13 swing from their ring-closing position to their ring-opening position, and on rotation of the shaft and offset in the opposite direction the swinging ring segments 13 swing from their ring-opening position to their ring-closing position. Referring particularly to FIGS. 17 and 18, it will be seen that the shaft 17 comprises two relatively long rods 17*a* and 17*b*, two relatively short end rods 17*c* and 17*d*, and three offsets each designated 19 and comprising a relatively short length of rod attached to respective ends of the rods 17*a–d*. Preferably, the shaft is made of a metal and the offsets 19 and rods 17*a–d* are attached such as by welding. However, the entire shaft could be a one-piece item, the offsets being bent out therefrom and integral therewith. The offsets 19 and corresponding links 21 are spaced along the length of the shaft 17 at intervals corresponding to the spacing of the rings R1, R2, R3. However, there may be a different number of offsets and corresponding links (other than three), and they may be arranged with a variety of lengthwise spacings along the base 3 and flap 23. Preferably, there is more than one offset and corresponding link so as to inhibit warping of the flap 23 which could result if all force is transmitted to the flap at a single location. Also preferably, the offsets and corresponding links are arranged to provide a generally symmetrical distribution of force lengthwise along the flap and a generally equal clamping force within each ring R1, R2, R3. For example, if there are two offsets and corresponding two links, each should be located more closely to an end ring R1, R3 than to the central ring R2, at a spacing very generally about ⅔ of the span between the central ring and the end ring.

Figure 20:
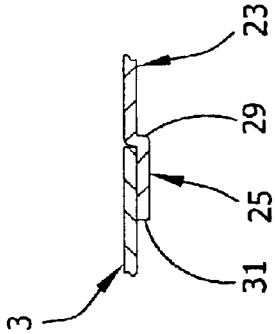
FIGS. 20 and 21 are fragmentary views in section generally on lines 20—20 and 21—21, respectively, of FIG. 19.
Figure 21:
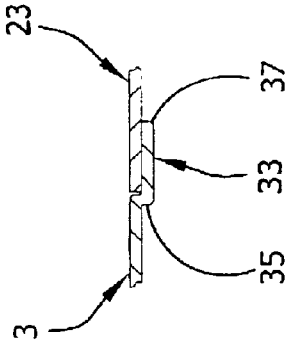
Figure 19:
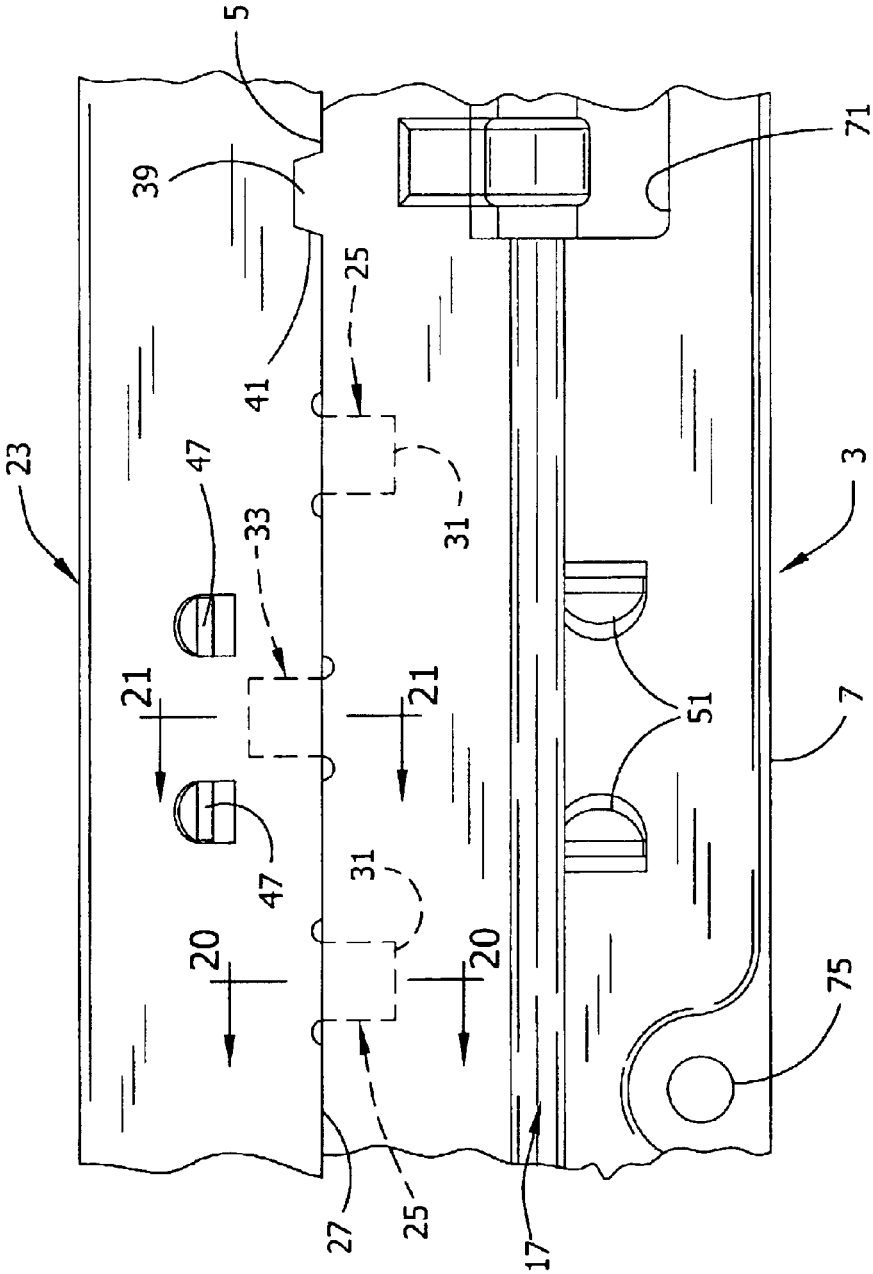
FIG. 19 is an enlarged fragment of FIGS. 1 and 5.

The hinging of the flap 23 on the base 3 is effected by having tabs 25 formed on edge 27 of the flap 23 contiguous to edge 5 of the base 3 (see particularly FIGS. 19–21 for this detail). Each tab 25 is bent to have a downwardly extending proximal portion 29 and an outwardly extending distal portion 31 which underlies the base 3. Additional tabs 33 are formed on edge 5 of the base 3, each of which is similarly bent to have a downwardly extending proximal portion 35 and an outwardly extending distal portion 37 which underlies the flap 23. At least one tab 39 projects from edge 5 of the base 3 into a corresponding notch 41 in the flap 23 for appropriate lengthwise location of the flap on the base.

The flap 23 is held in pivoted assembly with the base plate 3 by a pair of U-shaped spring wire hinge connectors, each designated 43 in its entirety (FIGS. 3 and 7), on the bottom of the base plate 3 and flap 23. The cross-wire 45 of each spring wire connector 43 is held in place by clips 47 struck out of and down from the flap 23, and the arms 49 of the connectors are held in place by clips 51 struck out of and down from the base plate 3. Ends 53 of the arms are bent around these clips 51. The arms 49 are generally straight when the flap 23 is down; the portion of each connector underlying the flap bends up springwise when the flap swings up. Arms 49 then tend to straighten out, i.e., each connector 43 tends to revert to being flat, and the connectors 43 then impose a downward bias on the flap. The spring wire connectors 43 may be held in place other than by the clips 47 and 51, such as by inserting the cross-wire 45 or arms 49 through a slot (not shown) in the base or flap and bending it around an edge of that slot. The ring binder 1 may have another type of spring, such as a leaf spring or coil spring located above or adjacent to the base 3, or may have no spring and therefore no downward bias, without departing from the scope of this invention.

The shaft 17 is mounted for rotation on axis A2 on and relative to the base 3 by being journalled in bearings 55 constituted by tabs struck up from the base 3 and circularized, there being such bearings for rods 17*a, b, c, d* making up the shaft adjacent the ends of the rods adjacent the offsets 19. The construction of the bearings 55 and the location of the shaft 17 on the top surface of the base 3 provides for economical manufacture and assembly of the ring binder 1.

Figure 23:
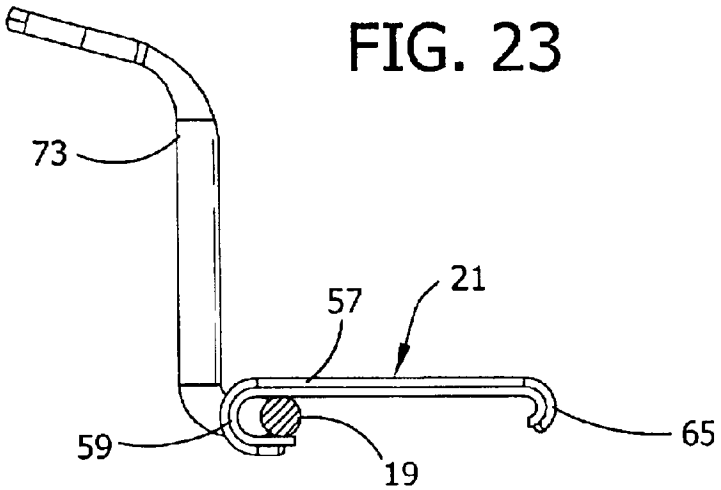
FIGS. 22–24 are view of details.
Figure 24:
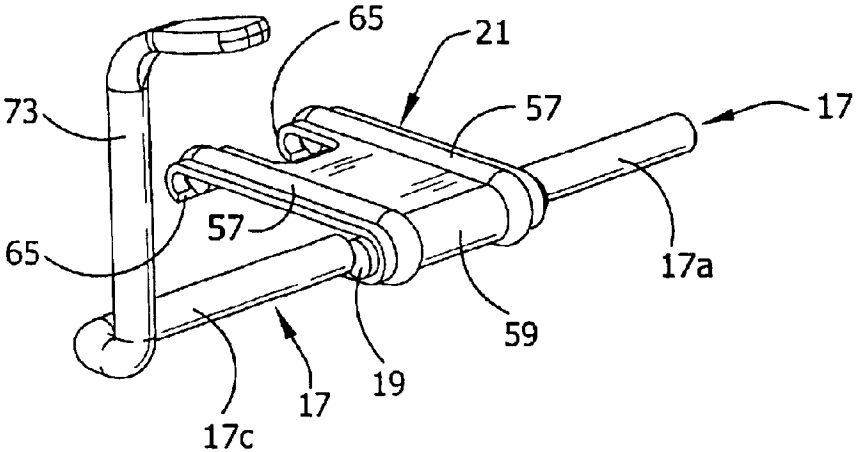
Figure 22:
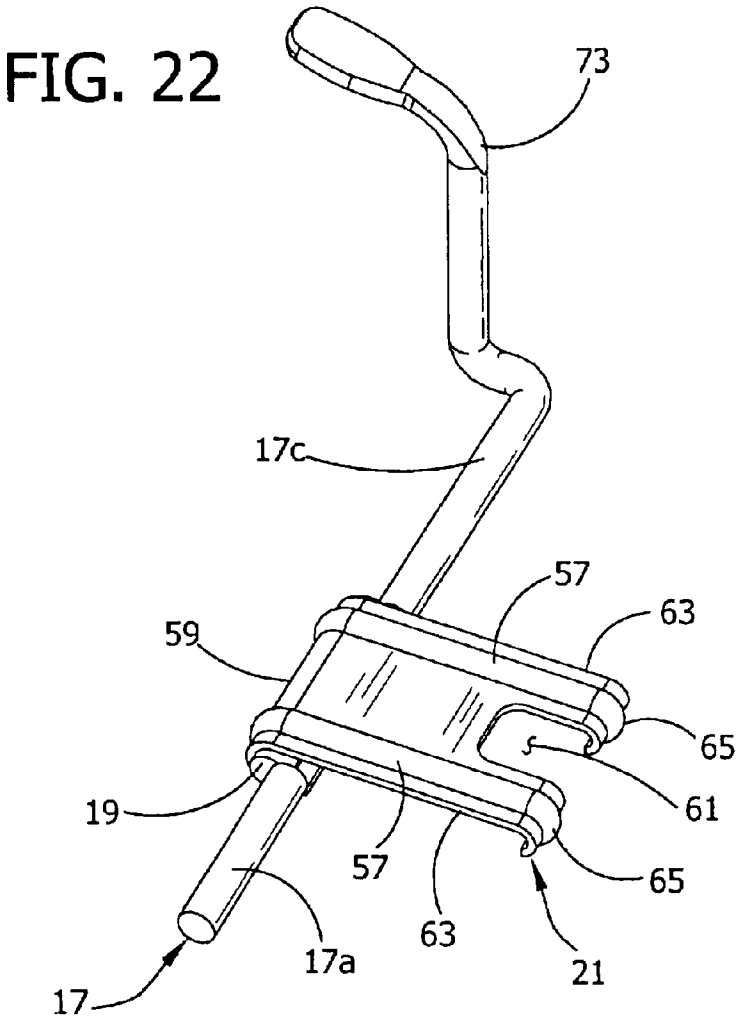

Each link 21 extends from one of the offsets or cranks 19 to the flap 23. Each link 21 comprises a generally flat strip of substantial width (in direction lengthwise of the base 3), the width generally corresponding to a size of the corresponding offset 19 for effective engagement by the offset. An advantage of the relatively wide strip is a broader distribution of force on the shaft 17 and flap 23 to avoid deflections or warp. However, each link could comprise a rod or thin member without departing from the scope of this invention. Each link 21 has stiffening ribs 57 extending lengthwise thereof. One end 59 of each link is bent to extend so as to be adapted to hook around the respective offset or crank 19 (see particularly FIG. 23). The other end of each link is slotted as indicated at 61 thereby forming it with two arms 63 straddling the respective ring segment 13, the ends 65 of the arms being hooked into slots 67 in the flap 23 forming rotatable connections with the flap. The base 3 is formed with stamped-down parts 69 forming cavities 71 accommodating the offsets 19. Preferably, the links 21 are formed of stamped sheet metal. If the links 21 are positioned at an alternate spacing other than at the rings (not shown), each link may be free from slot 61, with a generally solid construction along its length, because there is no need to straddle a ring segment.

As shown, the shaft 17 has a crank arm 73 extending laterally therefrom at end 9 of the base plate 3 swingable manually from the retracted ring-closing position in which it is shown in FIGS. 1–8 through the intermediate position of FIGS. 9–12 to the advanced ring-opening position of FIGS. 13–16. It may have a similar arm at the other end.

Figure 5:
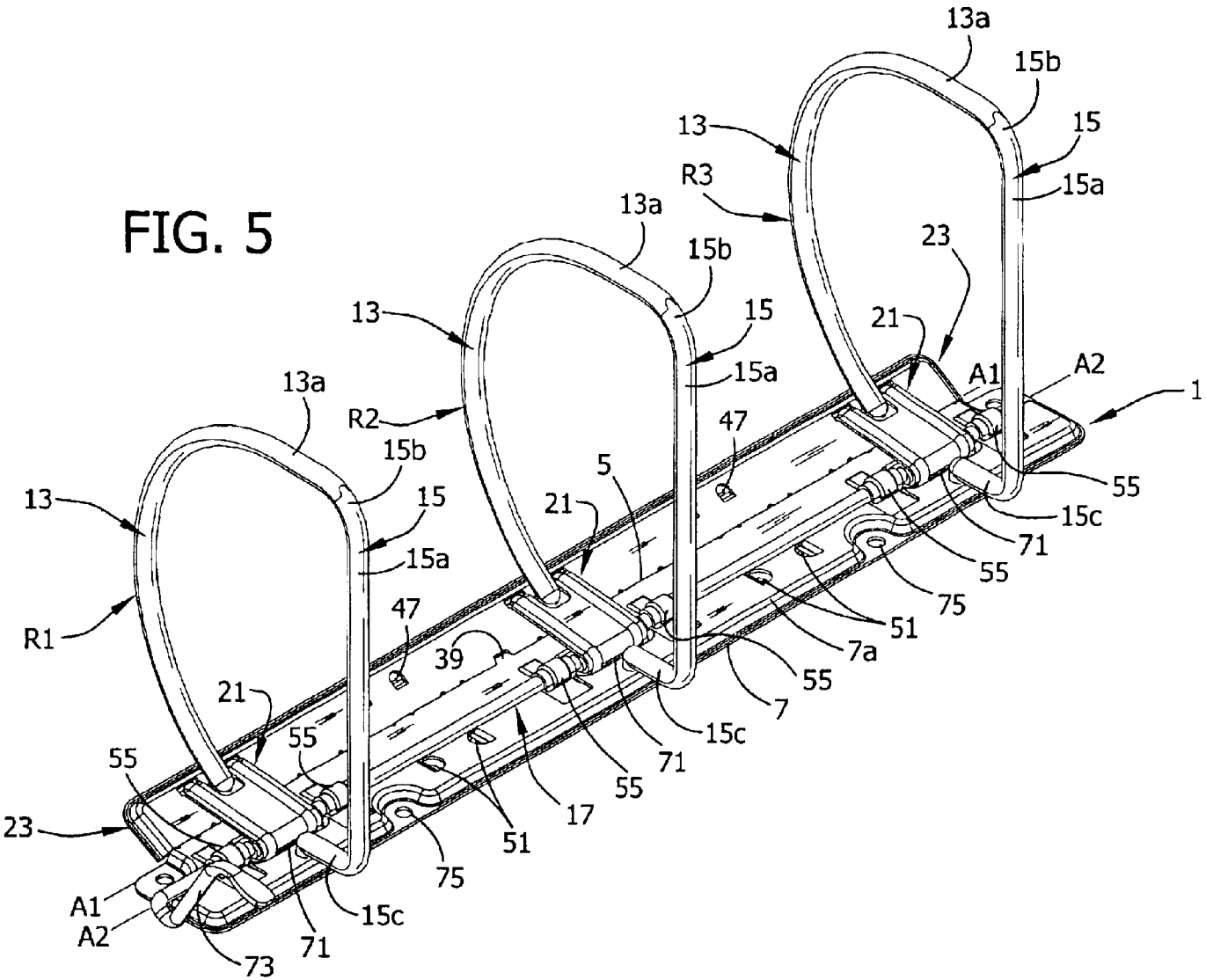
FIG. 5 is a perspective thereof as viewed from the top.
Figure 6:
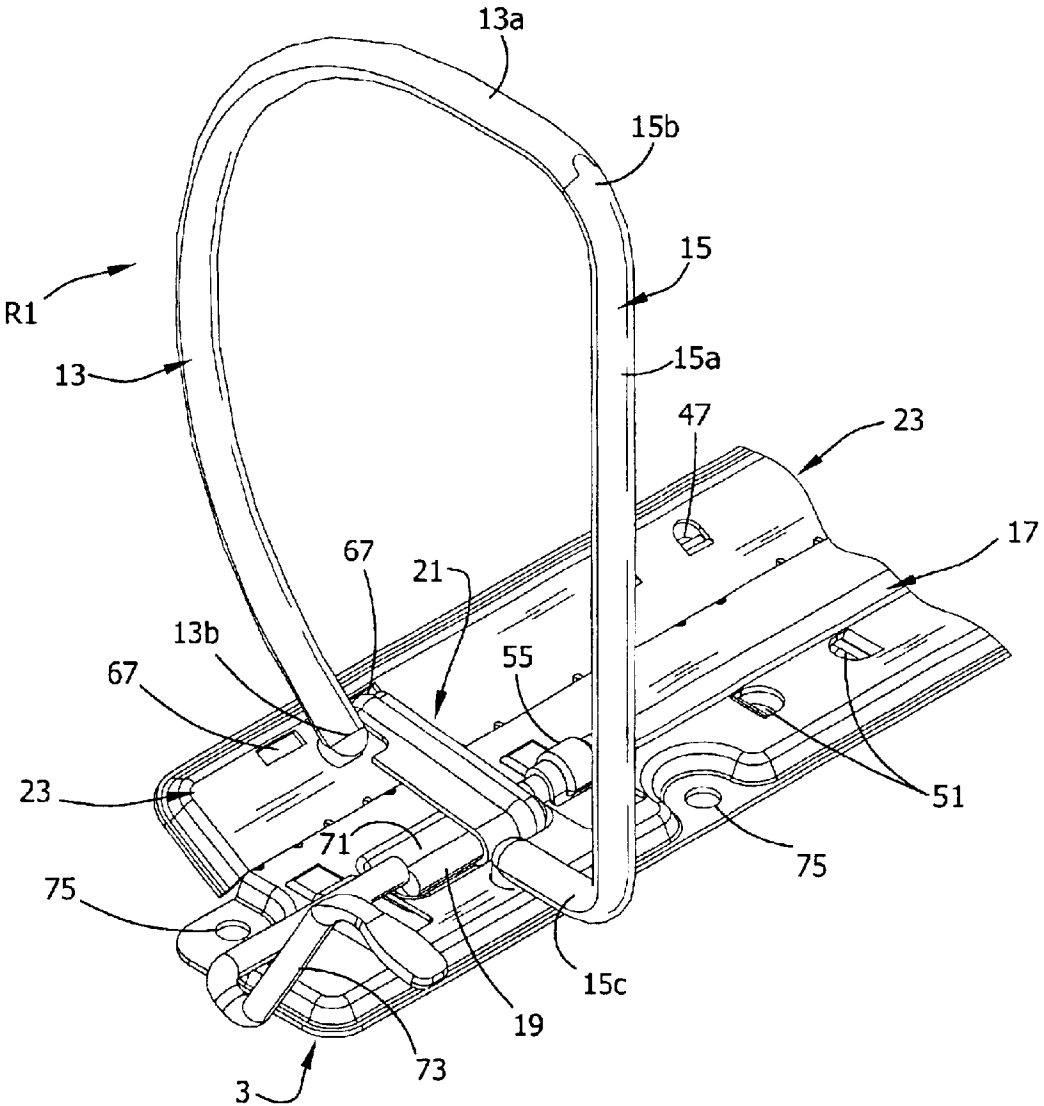
FIG. 6 is an enlarged fragment of FIG. 5, a part being broken away.
Figure 7:
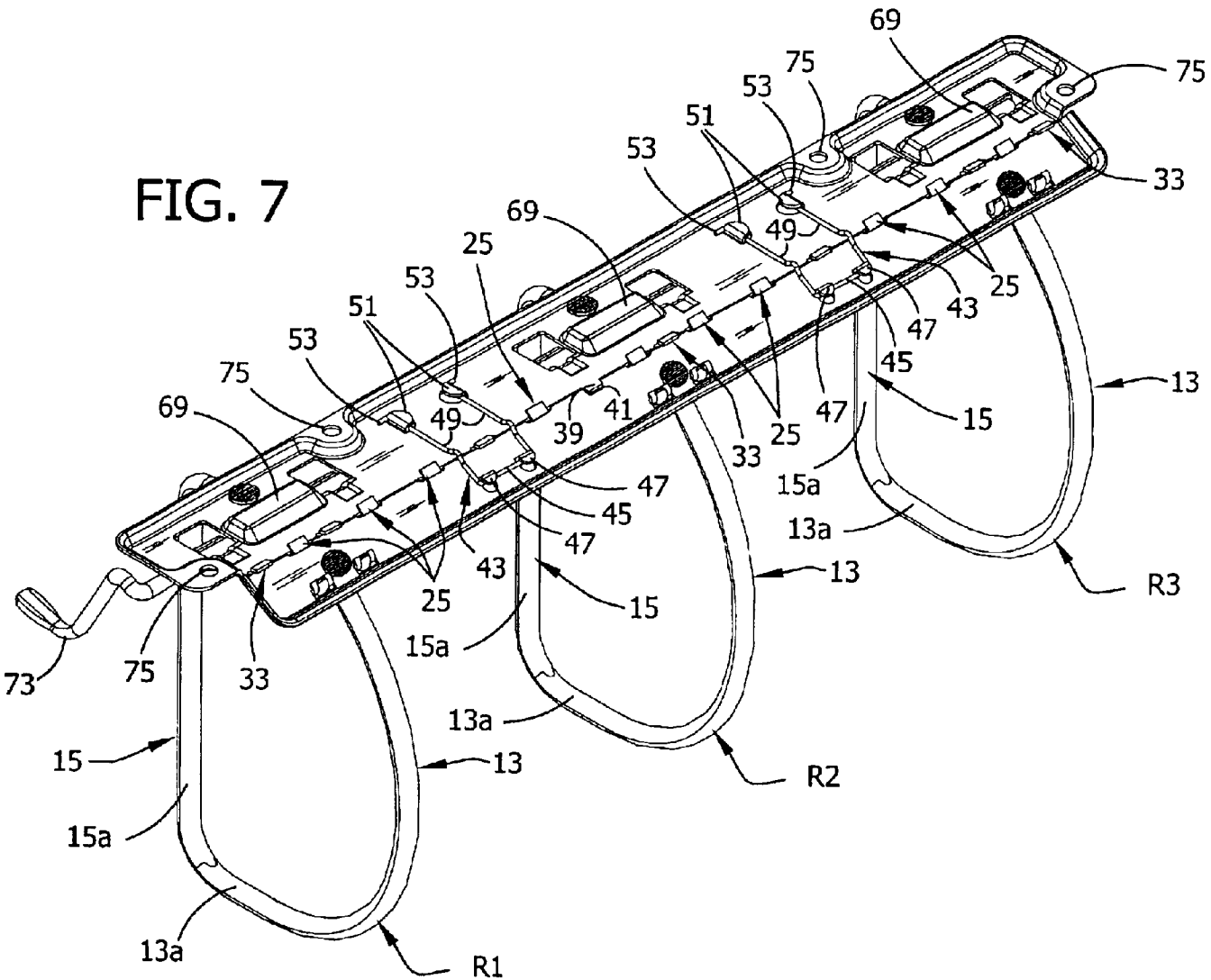
FIG. 7 is a perspective of the FIG. 1 ring binder as viewed from the bottom.
Figure 8:
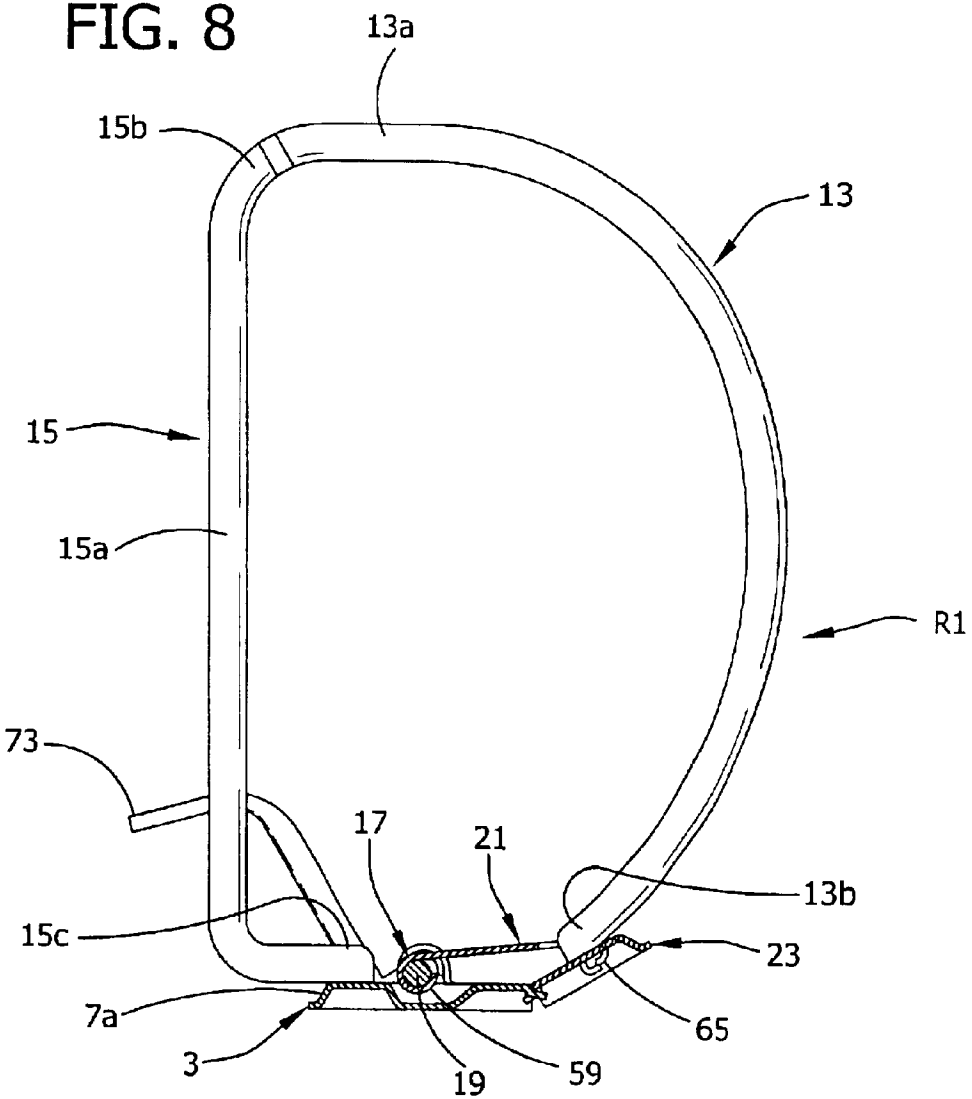
FIG. 8 is a vertical section taken generally on line 8—8 of FIG. 2.
Figure 9:
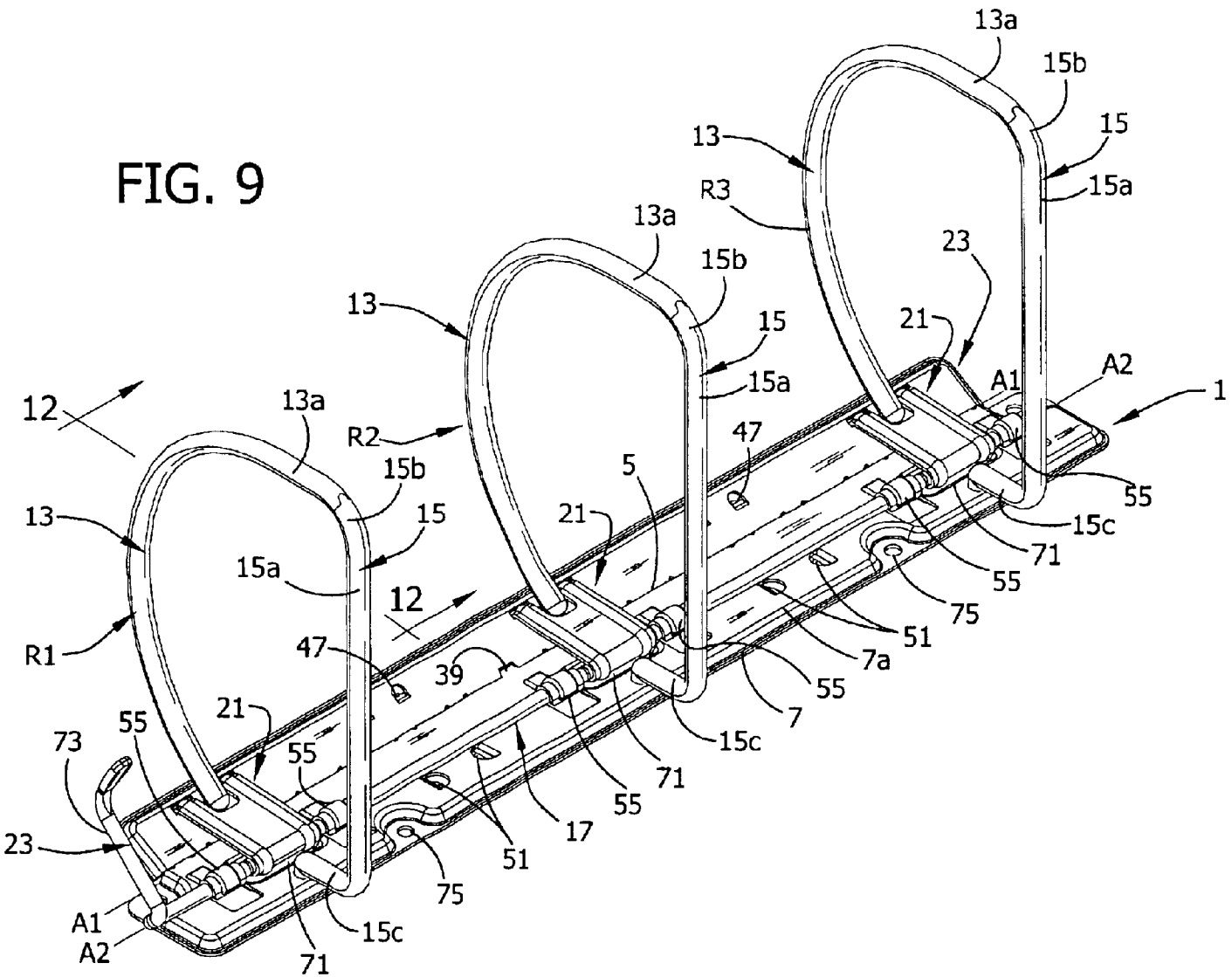
FIG. 9 is a perspective like FIG. 5 showing the crank arm and crankshaft in a moved position, the rings still being closed but unlocked.
Figure 10:
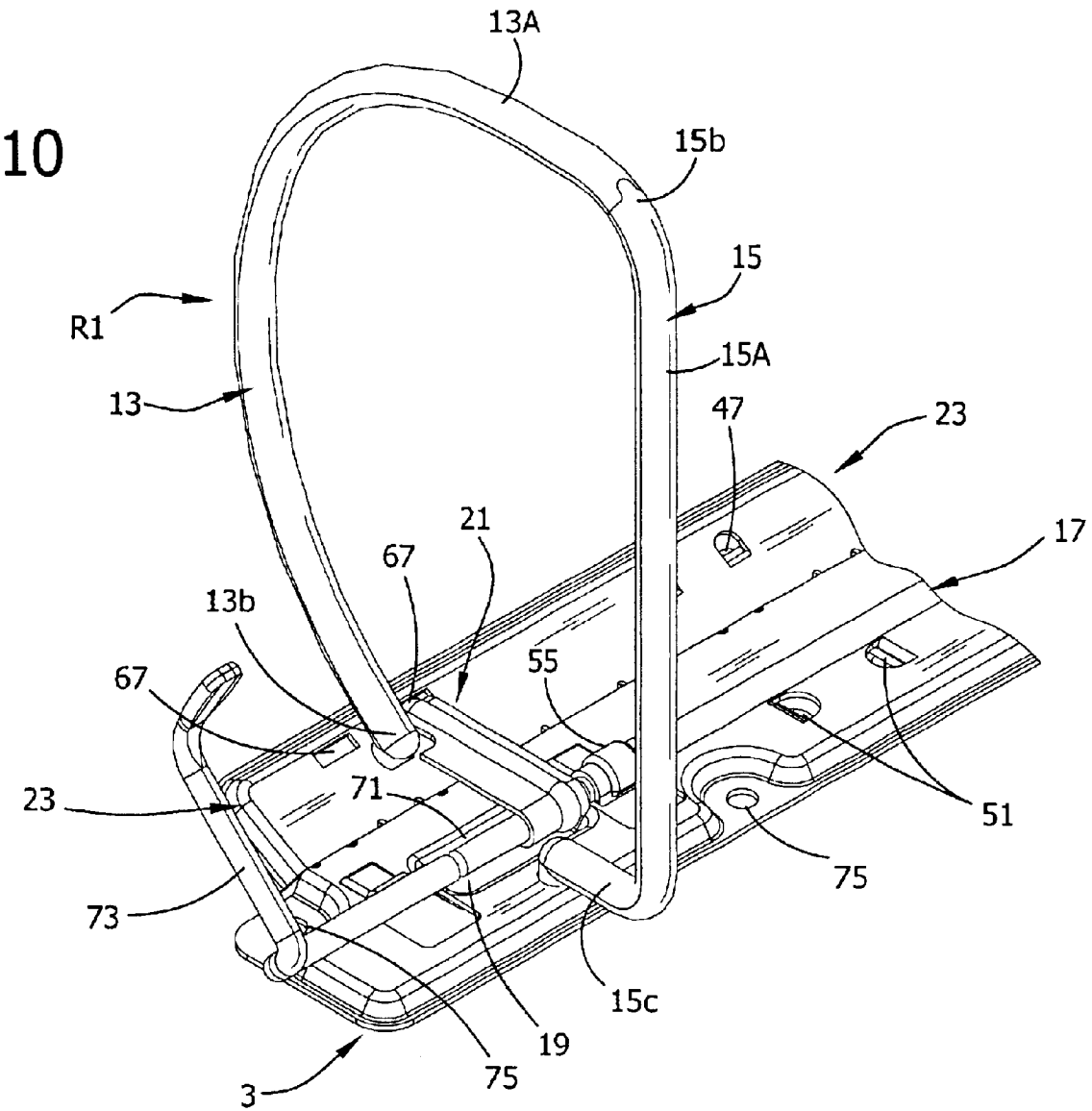
FIG. 10 is an enlarged fragment of FIG. 9, a part being broken away.
Figure 11:
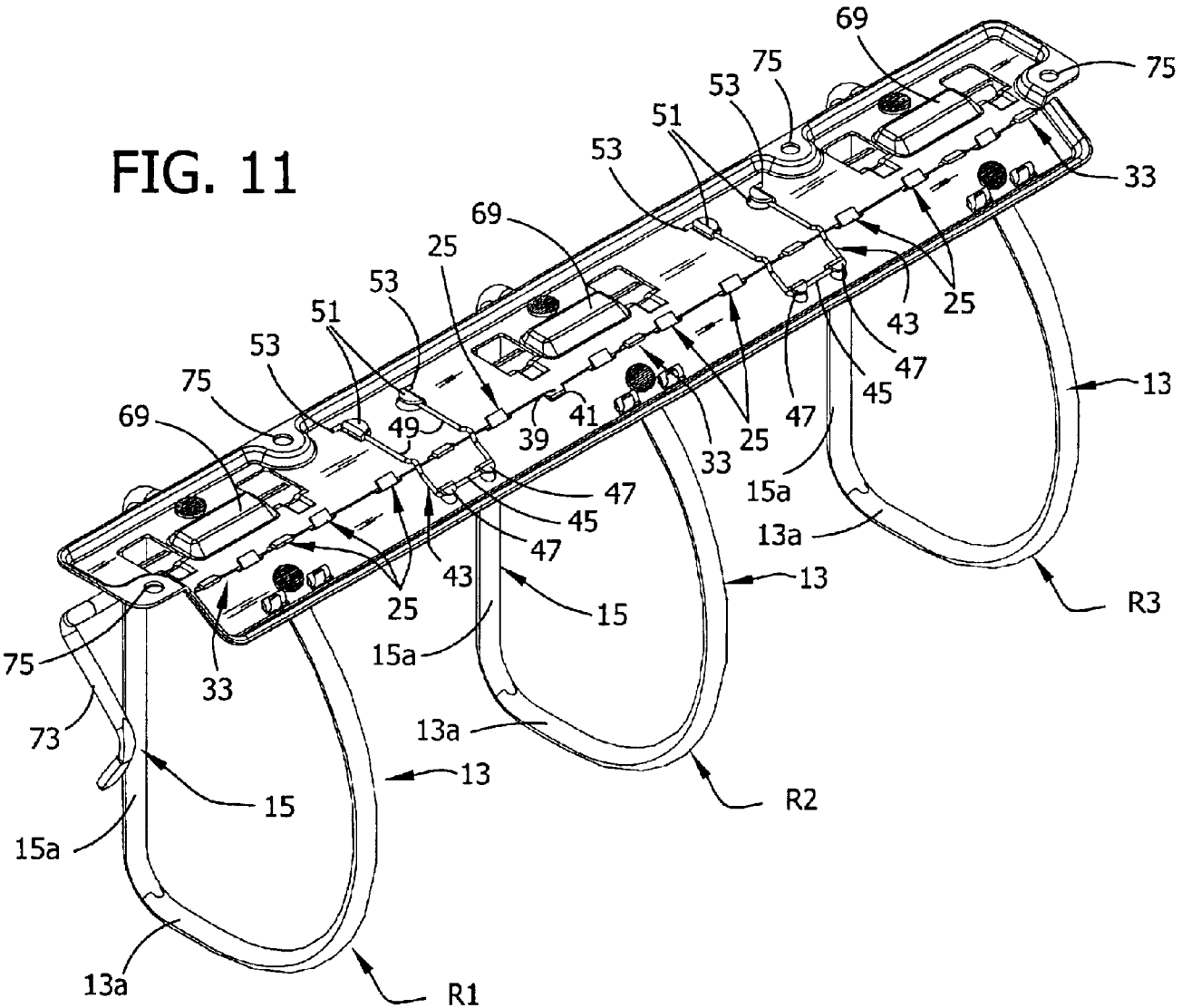
FIG. 11 is a perspective as viewed from the bottom of FIG. 9.
Figure 12:
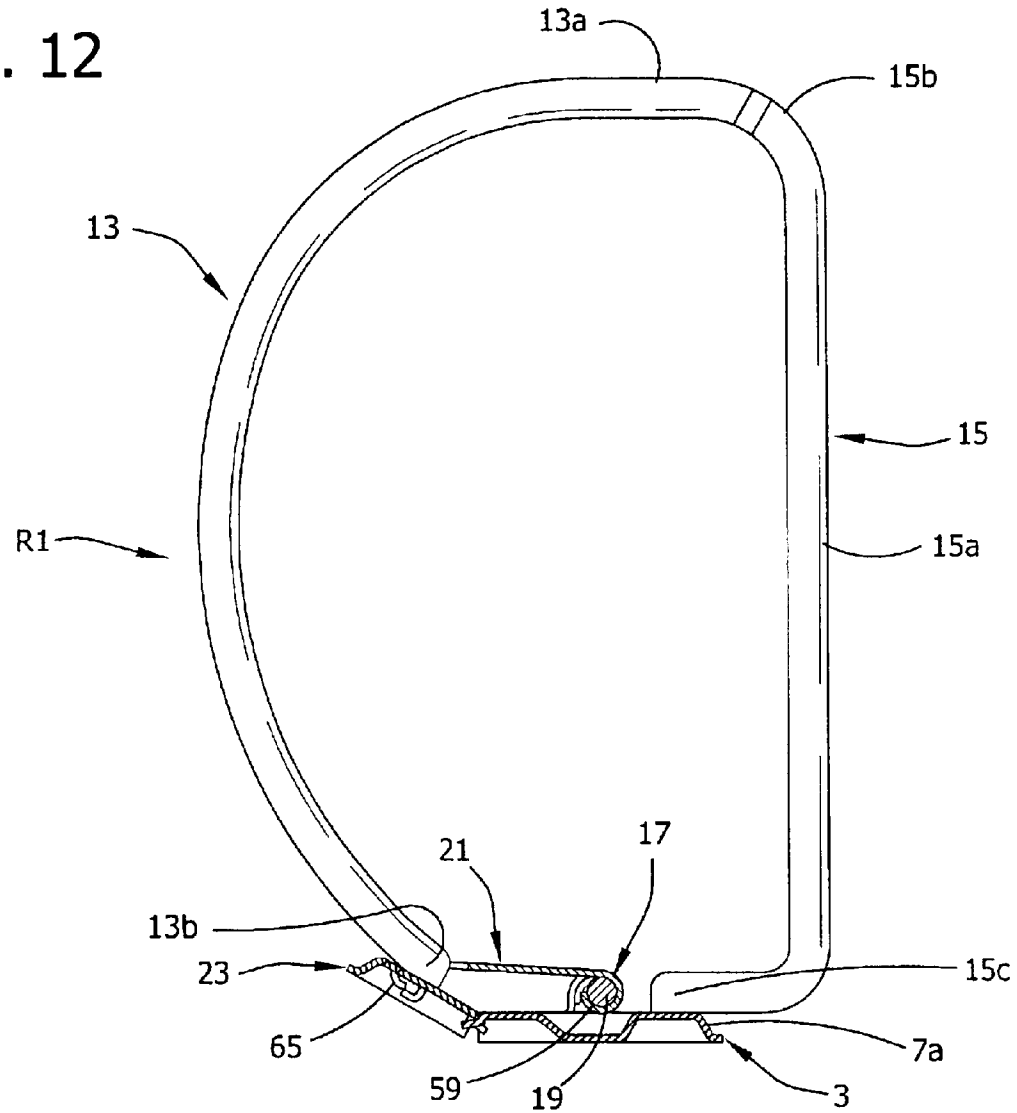
FIG. 12 is a vertical section taken generally on line 12—12 of FIG. 9.

With the crank arm 73 in the angular position shown in FIGS. 1–8, the offsets or cranks 19 are in the angular position of their rotation in which, by reason of their engagement with the bent ends 59 of the links 21, they have pulled the links in the direction toward the right as viewed in FIGS. 4–6 and thereby swung the flap 23 up to its raised position wherein the ring segments 13 are closed on segments 15 and the rings R1, R2, R3 are closed and locked closed. The offsets 19 are positioned toward the right as viewed in FIGS. 4–6, horizontally offset from the rods 17*a–d*. Force tending to open the rings R1, R2, R3 is firmly opposed because the links 21 pull laterally on the shaft 17, and there is little tendency to rotate toward the open position because at that offset position, there is no torque applied by the links to the shaft. Opening force applied to the ring members urges the connecting links to move generally horizontally, and that motion is strongly opposed. Clamping force in the rings R1, R2, R3 is maximized because the flap 23 is pulled by the links 21 to angle of inclination relative to the base 3.

On swinging the crank arm 73 upward (counterclockwise as viewed in FIG. 4), as it generally attains the intermediate position in which it is shown in FIGS. 9–12, the offsets or cranks 19 swing away from the bent ends 59 of the links 21, thereby freeing (unlocking) the links 21 for movement toward the left. The flap 23 stays up and the rings R1, R2, R3 remain closed. On further swinging of the crank arm 73 from its FIG. 9 position to its FIGS. 13–16 position, the flap 23 swings down under the aforesaid bias, the links 21 moving to the left away from the offsets, and the rings open.

On swinging the crank arm 73 back from its position of FIGS. 13–16, the action is generally in reverse. The offsets or cranks 19 engage the bent ends 59 of the links 21, pulling the links toward the left and thereby swinging the flap 23 up to close the rings R1, R2, R3.

The ring binder 1 is readily manipulable between open and closed positions. A strong clamping force is not being applied while the rings R1, R2, R3 move between the locked, unlocked (intermediate), and open positions. Unlike many binders of the prior art, there is no significant tension, such as in hinge plates, tending to close the rings. Accordingly, the force is relatively less when the ring members are moving. That permits the ring members to be easily opened or closed using less strength by an operator. It also inhibits injury should the operator inadvertently place a finger or hand in position between ring members while they are being clamped together.

The binder 1 of the present invention effectively retains loose leaf pages. The mechanism does not snap shut with a strong force which might injure a person who inadvertently places a finger or hand between ring members as they clamp together. The rings R1, R2, R3 may be moved by application of force at only one crank arm 73, and the magnitude of force is less than on opening and closing ring binders of the prior art. The mechanism distributes force generally uniformly to the three rings. The binder may be controllably placed in a locked position for securing loose leaf sheets and inhibiting inadvertent opening.

Figure 26:
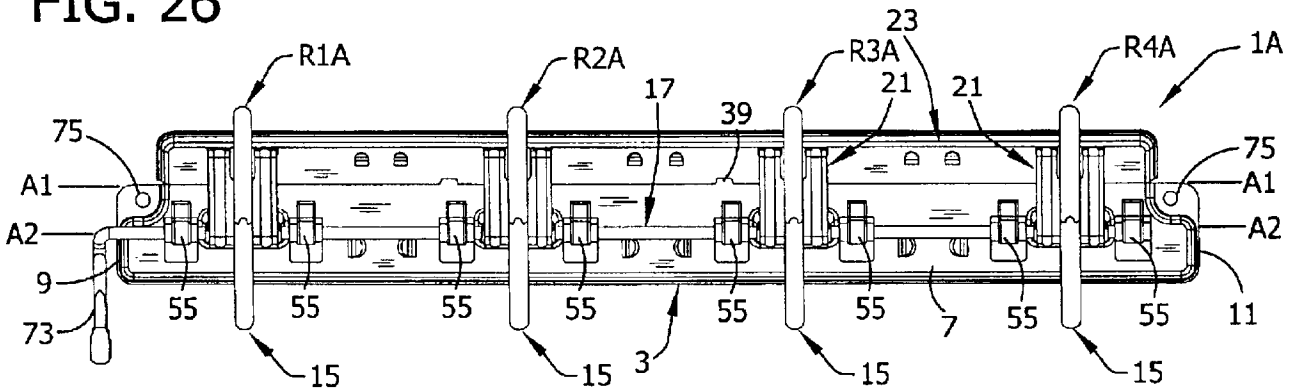
FIG. 26 is a top plan like FIG. 1 of a modification of the invention having generally rectangular rings.
Figure 27:
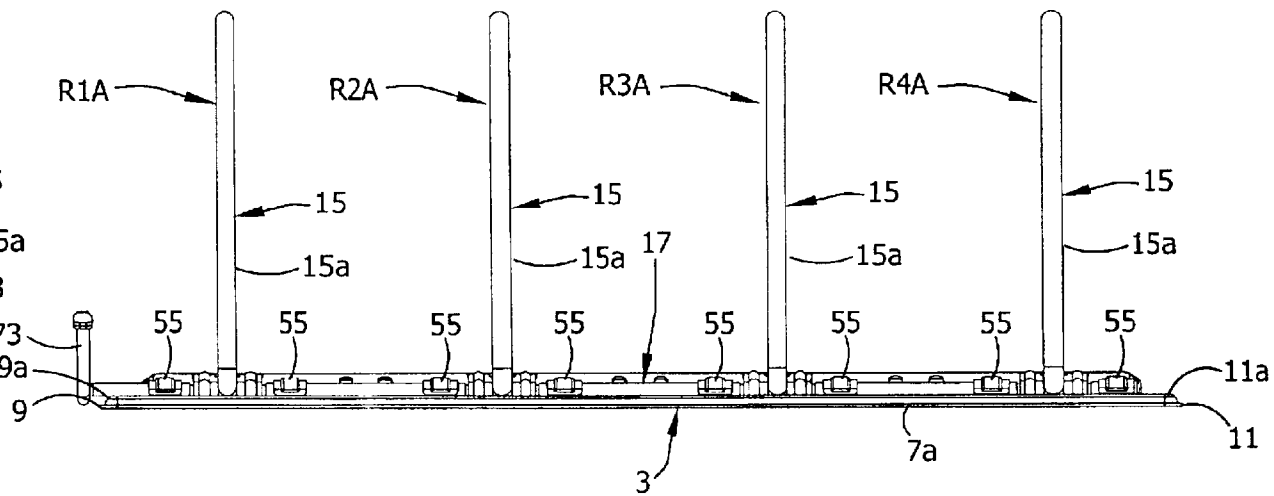
FIG. 27 is a side elevation of FIG. 26.
Figure 28:
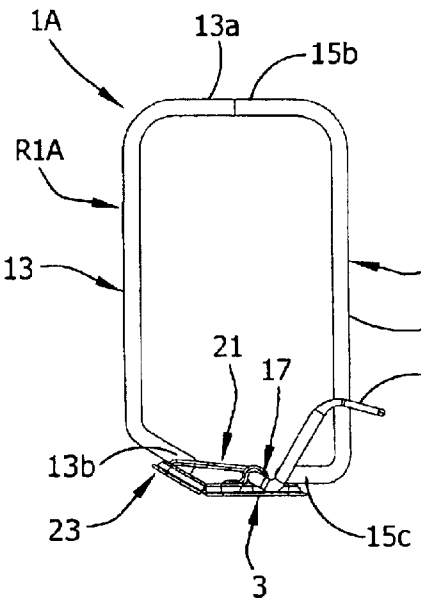
FIG. 28 is an end elevation of FIG. 27 as viewed from the left.

FIGS. 26–28 illustrate a modification 1A having four rings R1A, R2A, R3A, and R4A and wherein the rings are generally of rectangular conformation, differing from those of the ring binder 1 in that each of the left-hand ring segments, each of which is designated 13A, has a relatively long linear upright component 13Aa instead of the concavo-convex segment, and there are four rings, four hinges, four offsets and four links. Otherwise the modification 1A is essentially similar to the ring binder 1.

Figure 29:
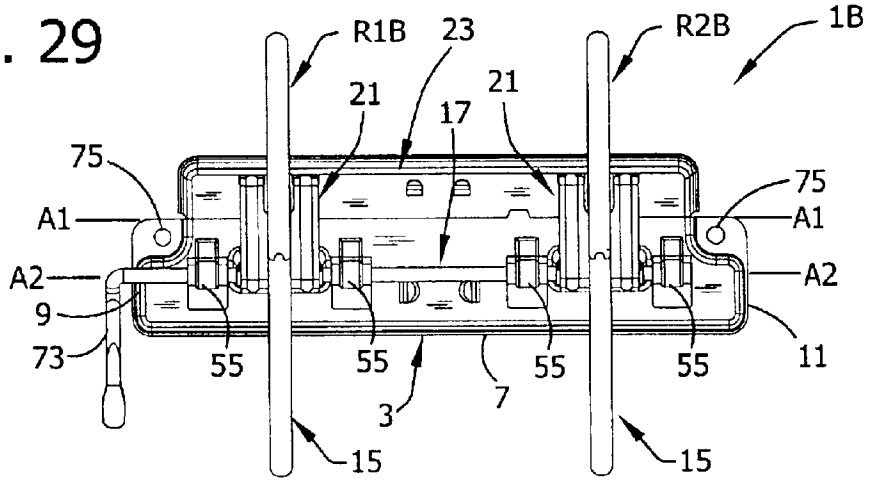
FIG. 29 is a top plan of another modification having two circular rings.
Figure 30:
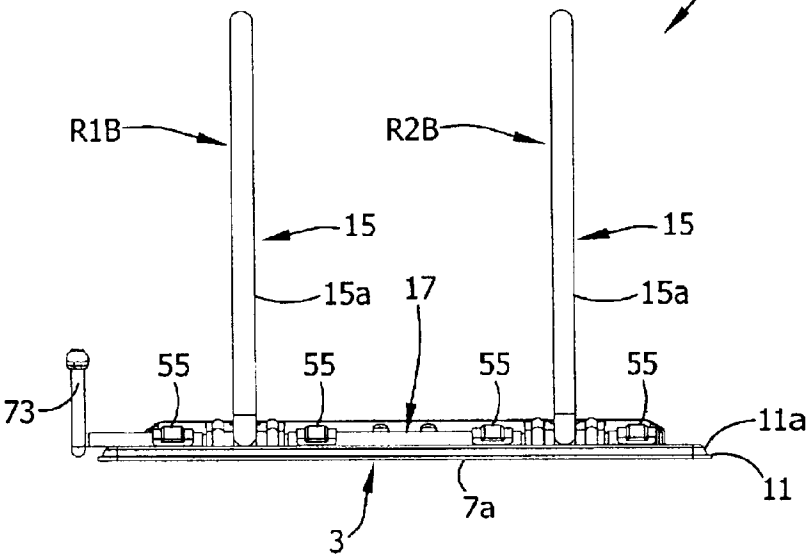
FIG. 30 is a side elevation of FIG. 29.
Figure 31:
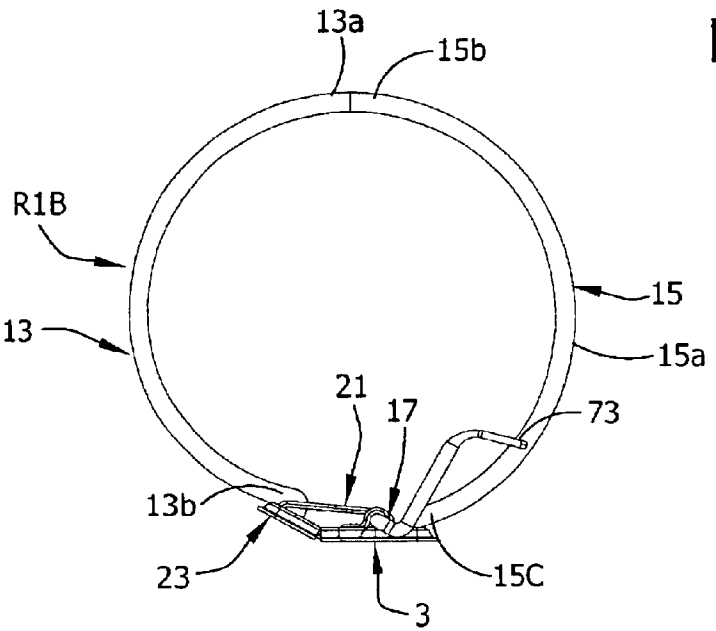
FIG. 31 is a left end view of FIG. 30.

FIGS. 29–31 illustrate another modification 1B having two rings R1B and R2B and wherein the rings are generally of circular modification, differing from those of the ring binders 1 and 1A in that each ring segment 13Ba and 15Ba is generally semicircular and there are two rings, two hinges, two offsets and two links. Otherwise the modification 1B is essentially similar to the ring binder 1.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

When introducing elements of the present invention or the preferred embodiments thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A ring binder, particularly for use in a loose-leaf binder, comprising an elongate base having opposite sides and ends, rings spaced longitudinally of the base, each ring comprising a pair of ring segments, one segment of each pair being mounted on the base for swinging movement about an axis extending lengthwise of the base between a ring-closing position and a ring-opening position, a shaft mounted on the base for rotation on an axis extending lengthwise of the base, said shaft having at least one offset, said ring binder having at least one link extending from the offset to the swinging ring segments, whereby on rotation of the shaft and offset in one direction the swinging ring segments swing from their ring-closing position to their ring-opening position and on rotation of the shaft and offset in the opposite direction the swinging ring segments swing from their ring-opening position to their ring-closing position.

2. A ring binder as set forth in claim 1 wherein the shaft has an arm at one end, at least, for turning it.

3. A ring binder as set forth in claim 1 wherein the swinging ring segments are biased to swing in ring-opening direction.

4. A ring binder as set forth in claim 1 wherein the shaft has a crank arm at one end, at least, for turning it and wherein the swinging ring segments are biased to swing in ring-opening direction.

5. A ring binder as set forth in claim 1 wherein the shaft comprises a plurality of coaxial metal rods including relatively long rods, the offsets comprising relatively short rods secured between the coaxial rods.

6. A ring binder as set forth in claim 5 wherein said at least one link comprises a generally flat strip sized to engage a corresponding offset.

7. A ring binder as set forth in claim 1 in combination with the loose-leaf binder.

8. A ring binder, particularly for use in a loose-leaf binder, comprising an elongate base having opposite sides and ends, a flap extending along one side of the base hinged to the base for swinging movement about an axis extending along said one side between a raised and a lowered position, rings each comprising a ring segment fixed to the base and a mating ring segment secured to the flap, the mating ring segments being swung away from the fixed ring segments when the flap is down in lowered position so that the rings are then open and the mating position so that the rings are then open and the mating ring segments being closed on the fixed ring segments when the flap is up in raised position so that the rings are then closed, a shaft mounted on the base for rotation on an axis extending longitudinally of the base, said shaft having at least one offset, and a link extending from the offset to the flap for swinging the flap.

9. A ring binder as set forth in claim 8 wherein the shaft has an arm at one end, at least, for turning it.

10. A ring binder as set forth in claim 8 wherein the flap is biased to swing down to its lowered position.

11. A ring binder as set forth in claim 8 wherein the flap has a first side hinged to the base and positioned generally along said axis and a second side positioned away from the base.

12. A ring binder as set forth in claim 8 wherein the shaft comprises a plurality of coaxial metal rods including relatively long rods, the offsets comprising relatively short rods secured between the coaxial rods.

13. A ring binder as set forth in claim 8 wherein the shaft is journalled on the base in circularized tabs.

14. A ring binder as set forth in claim 13 wherein the base comprises a sheet metal plate and the tabs are struck up from the plate.

15. A ring binder as set forth in claim 8 wherein the base comprises a sheet metal plate formed with stamped-down parts forming cavities for the offsets.

16. A ring binder as set forth in claim 8 wherein the flap is hinged to the base by at least one spring hinge subjecting the flap to bias tending swing it down to its lowered position.

17. A ring binder as set forth in claim 8 wherein the flap has a first side hinged to the base and positioned generally along said axis and a second side positioned away from the base.

18. A ring binder as set forth in claim 8 wherein the base comprises a sheet metal plate, the flap is a sheet metal flap, and the flap is hinged to the plate by at least one spring wire hinge held in place by clips struck out of the plate and flap.

19. A ring binder as set forth in claim 8 wherein the base comprises a sheet metal plate and the flap is a sheet metal flap, the flap having tabs underlying the plate and the plate having tabs underlying the flap.

20. A ring binder as set forth in claim 8 wherein said at least one link comprises a generally flat strip sized to engage a corresponding offset.

21. A ring binder as set forth in claim 8 having three rings, three offsets and three links.

22. A ring binder as set forth in claim 8 having four rings, four offsets and four links.

23. A ring binder as set forth in claim 8 having two rings, two offsets and two links.

24. A ring binder as set forth in claim 8 in combination with the loose-leaf binder.

25. A ring binder particularly for use in a loose-leaf binder, comprising an elongate sheet metal plate constituting the base of the ring binder having opposite sides and ends, an elongate sheet metal flap extending along one side of the plate hinged thereto for swinging movement about an axis extending along said one side for swinging movement between a raised position relative to the plate and a lowered position generally coplanar with the plate, rings each comprising a ring segment fixed to the plate and a mating ring segment secured to the flap, the mating ring segments being swung away from the fixed ring segments when the flap is at the lowered position so that the rings are open and the mating ring segments being closed on the fixed ring segments when the flap is at the raised position so that the rings are then closed, the flap being hinged to the plate by at least one spring wire hinge on the bottom of the plate and flap, said spring wire hinge tending to bias the flap down to its lowered position, a crankshaft journalled on the base by clips struck up from the base and having at least one crank and a crank arm at an end thereof for turning the crankshaft, and at least one link extending from said at least one crank to the flap, the link pivotally connected to the flap and having a hook formation for hooking around said at least one crank.

26. A ring binder as set forth in claim 25 wherein the plate is formed with stamped-down parts forming cavities for the cranks.

27. A ring binder as set forth in claim 25 in combination with the loose-leaf binder.

* * * * *

UNITED STATES PATENT AND TRADEMARK OFFICE

CERTIFICATE OF CORRECTION

PATENT NO. : 6,974,273 B2
APPLICATION NO. : 10/196012
DATED : December 13, 2005
INVENTOR(S) : Hung Yu Cheng It is certified that error appears in the above-identified patent and that said Letters Patent is hereby corrected as shown below:

Column 8, claim 8, lines 12-13, "mating position so that the rings are then open and the mating ring" should read ---mating ring---.
(Application pages 19-20, claim 8, lines 10-12)

Signed and Sealed this

First Day of August, 2006

JON W. DUDAS
*Director of the United States Patent and Trademark Office*